US010916860B2

(12) United States Patent
Tarng et al.

(10) Patent No.: US 10,916,860 B2
(45) Date of Patent: Feb. 9, 2021

(54) COMPACT HIGH-GAIN PATTERN RECONFIGURABLE ANTENNA

(71) Applicants: NATIONAL CHIAO TUNG UNIVERSITY, Hsinchu (TW); QUANTA COMPUTER INC., Tao Yuan (TW)

(72) Inventors: Jenn-Hwan Tarng, Hsinchu (TW); Yu-Chen Lo, New Taipei (TW); Sung-Jung Wu, Taipei (TW); Nai-Chen Liu, Taichung (TW)

(73) Assignee: National Chaio Tung University Quanta Computer Inc., Tao Yuan (TW)

( * ) Notice: Subject to any disclaimer, the term of this patent is extended or adjusted under 35 U.S.C. 154(b) by 35 days.

(21) Appl. No.: 16/422,412

(22) Filed: May 24, 2019

(65) Prior Publication Data

US 2020/0203848 A1 Jun. 25, 2020

(30) Foreign Application Priority Data

Dec. 19, 2018 (TW) ..... 107145882 A

(51) Int. Cl.
*H01Q 19/28* (2006.01)
*H01Q 1/36* (2006.01)
(Continued)

(52) U.S. Cl.
CPC ..... *H01Q 19/28* (2013.01); *H01Q 1/36* (2013.01); *H01Q 1/48* (2013.01); *H01Q 9/045* (2013.01)

(58) Field of Classification Search
CPC ..... H01Q 19/28; H01Q 1/36; H01Q 1/48; H01Q 9/045; H01Q 9/30; H01Q 19/32
See application file for complete search history.

(56) References Cited

U.S. PATENT DOCUMENTS 6,337,668 B1 1/2002 Ito et al.
7,180,465 B2 * 2/2007 Lynch ..... H01Q 1/243 343/702
(Continued)

FOREIGN PATENT DOCUMENTS

CN 106129613 A 11/2016
TW I380509 B1 12/2012
(Continued)

OTHER PUBLICATIONS

English machine translation of "CN106129613A", Qiu et al., Nov. 16, 2016, pp. 1-10 (Year: 2016).*
(Continued)

*Primary Examiner* — Daniel D Chang
(74) *Attorney, Agent, or Firm* — Lewis Roca Rothgerber Christie LLP

(57) ABSTRACT

A pattern reconfigurable antenna includes a radiator, a first parasitic element, a second parasitic element, a ground plane, a first switch and a second switch. The radiator includes a feed portion and a radiating portion that are interconnected. The first and second parasitic elements are symmetrically located at two opposite sides of the radiating portion, and are closely adjacent to and spaced apart from the radiating portion. The ground plane is located at another side of the radiating portion, and is spaced apart from the first and second parasitic elements. Each of the first and second switches is connected between the ground plane and a respective one of the first and second parasitic elements, and is operable to establish connection between the same.

8 Claims, 14 Drawing Sheets

(51) Int. Cl.
*H01Q 1/48* (2006.01)
*H01Q 9/04* (2006.01)

(56) References Cited

U.S. PATENT DOCUMENTS

| | | | | |
|---|---|---|---|---|
| 8,766,871 | B2 * | 7/2014 | Hamabe | H01Q 21/06 343/893 |
| 9,263,798 | B1 | 2/2016 | Piazza et al. | |
| 2003/0193446 | A1 | 10/2003 | Chen | |
| 2012/0212389 | A1 * | 8/2012 | Aizawa | H01Q 21/28 343/853 |
| 2012/0287012 | A1 * | 11/2012 | Aizawa | H01Q 1/243 343/853 |

FOREIGN PATENT DOCUMENTS

| | | | |
|---|---|---|---|
| TW | I553960 | B | 10/2016 |
| TW | I600209 | B | 9/2017 |

OTHER PUBLICATIONS

Search Report appended to an Office Action, which was issued to Taiwanese counterpart application No. 107145882 by the TIPO dated Aug. 6, 2019, with an English translation thereof (2 pages).

S. Raman, N. Timmons and J. Morrison, "Gain enhanced pattern reconfigurable planar Yagi-Uda antenna on coplanar structure," in Electronics Letters, vol. 49, No. 25, pp. 1593-1595, Dec. 5, 2013.

X. Ding and B. Wang, "A Novel Wideband Antenna With Reconfigurable Broadside and Endfire Patterns," in IEEE Antennas and Wireless Propagation Letters, vol. 12, pp. 995-998, 2013.

F. Farzami, S. Khaledian, B. Smida and D. Erricolo, "Pattern-Reconfigurable Printed Dipole Antenna Using Loaded Parasitic Elements," in IEEE Antennas and Wireless Propagation Letters, vol. 16, pp. 1151-1154, 2017.

Y. Lu, Y. Huang, H. T. Chattha and P. Cao, "Reducing Ground-Plane Effects on UWB Monopole Antennas," in IEEE Antennas and Wireless Propagation Letters, vol. 10, pp. 147-150, 2011.

* cited by examiner

COMPACT HIGH-GAIN PATTERN RECONFIGURABLE ANTENNA

CROSS-REFERENCE TO RELATED APPLICATION

This application claims priority of Taiwanese Patent Application No. 107145882, filed on Dec. 19, 2018.

FIELD

The disclosure relates to a pattern reconfigurable antenna, and more particularly to a compact high-gain pattern reconfigurable antenna.

BACKGROUND

A pattern reconfigurable antenna provides a variable radiation pattern, and therefore can achieve dynamic radiation coverage, mitigation of multipath interference and adjustment of the gain in a specific direction, so as to improve efficiency of a wireless system.

Referring to FIG. 1, a conventional pattern reconfigurable planar antenna 1 includes an insulating substrate 11, a radiator 12, a first parasitic element 13, a second parasitic element 14, a ground plane 15 and four PIN diodes (S1-S4). The radiator 12 is disposed on a first surface of the insulating substrate 11. The first and second parasitic elements 13, 14 are disposed on a second surface of the insulating substrate 11 opposite to the first surface, and are symmetrically located at two opposite sides of a projection of the radiator 12 on the second surface. The ground plane 15 is disposed on the first surface, and includes two portions that are respectively located at two opposite sides of the radiator 12.

The first parasitic element 13 is spaced apart from the radiator 12 by 0.25×λ, where λ denotes a wavelength in air corresponding to an operating frequency of the conventional pattern reconfigurable planar antenna 1. The first parasitic element 13 includes a first segment 131, a second segment 132 and a third segment 133 that are arranged in tandem, with the first segment 131 located between the second and third segments 132, 133. The PIN diode (S1) is connected between the first and second segments 131, 132. The PIN diode (S2) is connected between the first and third segments 131, 133.

Similarly, the second parasitic element 14 is spaced apart from the radiator 12 by 0.25×λ, and includes a first segment 141, a second segment 142 and a third segment 143 that are arranged in tandem, with the first segment 141 located between the second and third segments 142, 143. The PIN diode (S3) is connected between the first and second segments 141, 142. The PIN diode (S4) is connected between the first and third segments 141, 143.

When each of the PIN diodes (S1, S2) conducts while none of the PIN diodes (S3, S4) conducts, the first segment 131 is connected to the second and third segments 132, 133. At this time, the first parasitic element 13 has a resonant length that is greater than λ, and therefore acts as an inductive load that will result in current phase lag. In addition, since the first parasitic element 13 is spaced apart from the radiator 12 by 0.25×λ, radio waves radiated by the radiator 12 and radio waves radiated by the first parasitic element (due to absorption of the radio waves radiated by the radiator 12) are in phase at the radiator 12. Therefore, the first parasitic element 13 acts as a reflector. This results in a directional radiation pattern, in which the maximum radiation direction is oriented toward the second parasitic element 14.

Similarly, when each of the PIN diodes (S3, S4) conducts while none of the PIN diodes (S1, S2) conducts, the first second segment 141 is connected to the second and third segments 142, 143, and the second parasitic element 14 acts as a reflector. This results in a directional radiation pattern, in which the maximum radiation direction is oriented toward the first parasitic element 13.

Like the conventional Yagi-Uda antenna, the conventional pattern reconfigurable planar antenna 1 requires each of the first and second parasitic elements 13, 14 to be spaced apart from the radiator 12 by 0.25×λ, so as to achieve reflection effect. Therefore, the conventional pattern reconfigurable planar antenna 1 disadvantageously occupies a relatively large area.

SUMMARY

Therefore, an object of the disclosure is to provide a pattern reconfigurable antenna that can alleviate the drawback of the prior art.

According to the disclosure, the pattern reconfigurable antenna includes a radiator, a first parasitic element, a second parasitic element, a ground plane, a first switch and a second switch. The radiator includes a feed portion, and a radiating portion that is connected to the feed portion. The first and second parasitic elements are symmetrically located at two opposite sides of the radiating portion, and are closely adjacent to and spaced apart from the radiating portion. The ground plane is located at another side of the radiating portion, and is spaced apart from the first and second parasitic elements. The first switch is connected between the first parasitic element and the ground plane, and is operable to establish connection between the first parasitic element and the ground plane. The second switch is connected between the second parasitic element and the ground plane, and is operable to establish connection between the second parasitic element and the ground plane.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
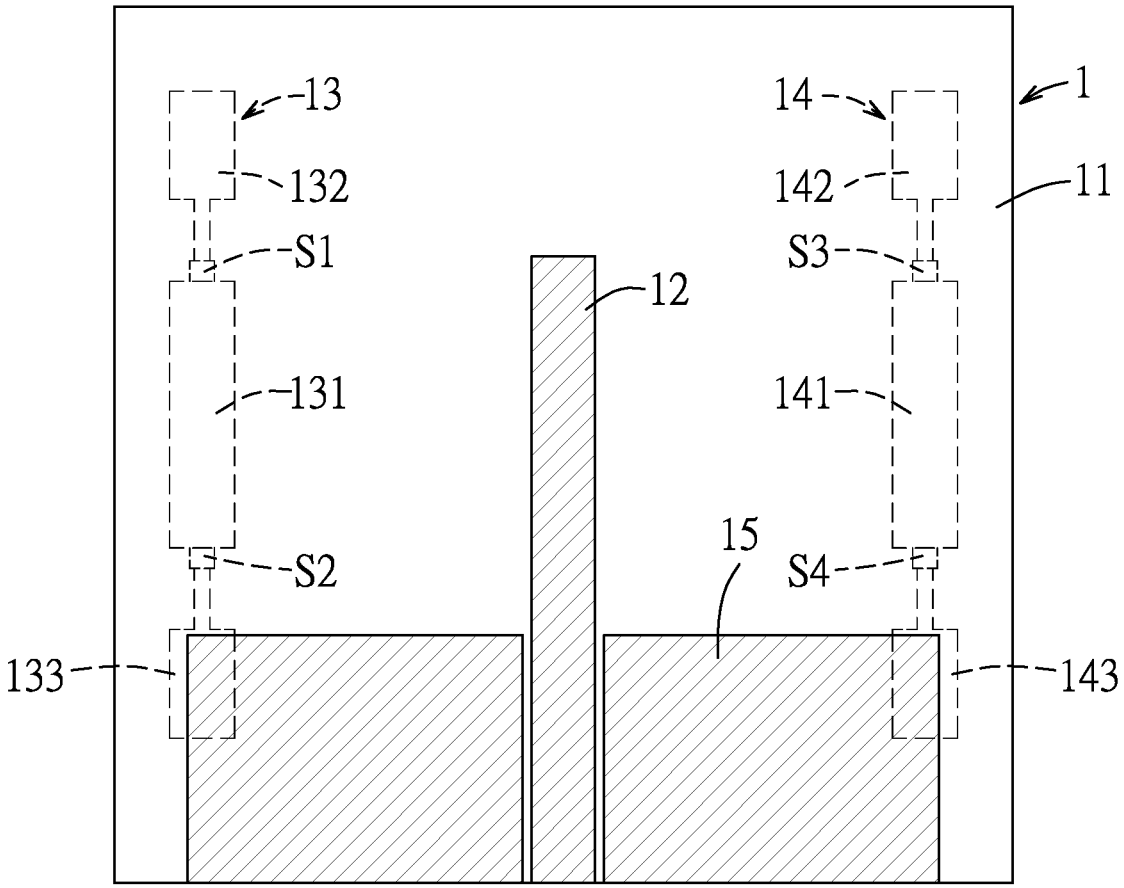
FIG. 1 PRIOR ART
FIG. 1 is a structural diagram illustrating a conventional pattern reconfigurable planar antenna.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
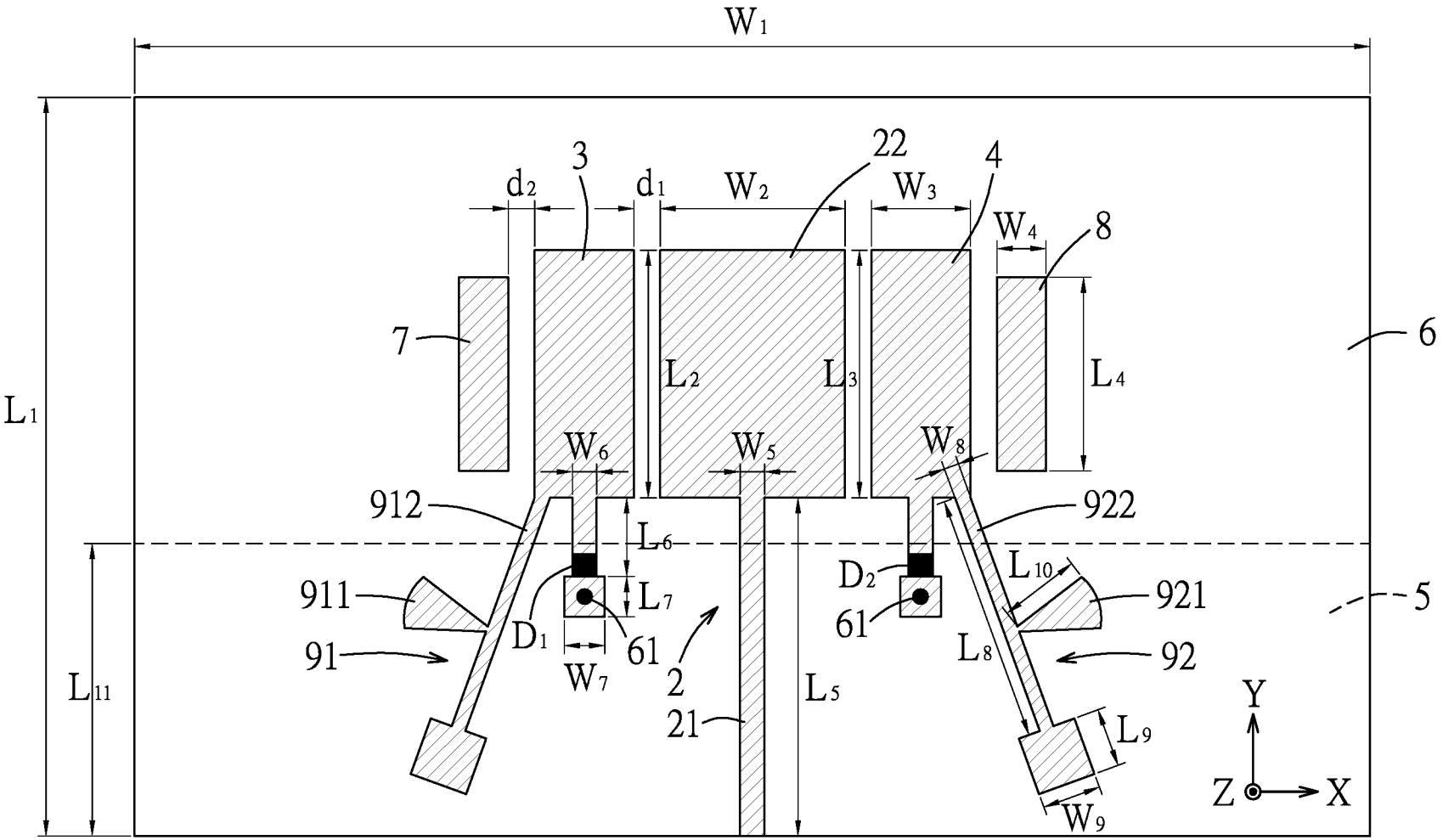
FIG. 2 is a structural diagram illustrating a first embodiment of a pattern reconfigurable antenna according to the disclosure.

Referring to FIG. 2, a first embodiment of a pattern reconfigurable antenna according to the disclosure includes a radiator 2, a first parasitic element 3, a second parasitic element 4, a ground plane 5, a first switch ($D_1$) and a second switch ($D_2$). The radiator 2 includes a feed portion 21, and a radiating portion 22 that is connected to the feed portion 21. The first and second parasitic elements 3, 4 are symmetrically located at two opposite sides of the radiating portion 22, and are closely adjacent to and spaced apart from the radiating portion 22. The ground plane 5 is located at another side of the radiating portion 22, and is spaced apart from the first and second parasitic elements 3, 4. The first switch ($D_1$) is connected between the first parasitic element 3 and the ground plane 5, and is operable to establish connection therebetween. The second switch ($D_2$) is connected between the second parasitic element 4 and the ground plane 5, and is operable to establish connection therebetween.

In this embodiment, the pattern reconfigurable antenna further includes an insulating substrate 6. The substrate 6 lies in an X-Y plane (which is defined by an X direction and a Y direction that are perpendicular to each other), includes a first surface and a second surface (which are opposite to each other in a Z direction perpendicular to the X and Y directions), and is formed with two through holes 61 (each of which extends in the Z direction). The radiator 2, the first and second parasitic elements 3, 4 and the first and second switches ($D_1$, $D_2$) are disposed on the first surface. The ground plane 5 is disposed on the second surface. Each of the first and second switches ($D_1$, $D_2$) is connected to the ground plane 5 via a respective one of the through holes 61. The radiator 2 has a monopole configuration. The feed portion 21 extends in the Y direction from an edge of the substrate 6 to the radiating portion 22. The radiating portion 22 and the first and second parasitic elements 3, 4 are arranged in the X direction. The ground plane 5 overlaps a projection of the feed portion 21 on the second surface. It should be noted that, in other embodiments, the ground plane 5 may be disposed on the first surface, and may include two portions that are respectively located at two opposite sides of the feed portion 21 and that are spaced apart from the feed portion 21.

In this embodiment, each of the radiating portion 22 and the first and second parasitic elements 3, 4 is a rectangular metal patch, and each of the first and second switches ($D_1$, $D_2$) is a radio frequency (RF) switch (e.g., a PIN diode).

In this embodiment, the pattern configurable antenna further includes a first director 7 and a second director 8. The first and second directors 7, 8 are disposed on the first surface of the insulting substrate 6. The first director 7 is located at a side of the first parasitic element 3 that is distal from the radiating portion 22. The second director 8 is located at a side of the second parasitic element 4 that is distal from the radiating portion 22. Each of the first and second directors 7, 8 is a rectangular metal patch. It should be noted that, in other embodiments, the first and second directors 7, 8 may be omitted depending on application requirements.

In a scenario where the pattern reconfigurable antenna of this embodiment is operable at an operating frequency of 28 GHz, example values for various dimensions of the pattern reconfigurable antenna of this embodiment are given in Table 1.

TABLE 1

| $W_1$ | $W_2$ | $W_3$ | $W_4$ | $W_5$ | $W_6$ | $W_7$ | $W_8$ | $W_9$ |
|---|---|---|---|---|---|---|---|---|
| 20 | 3 | 1.6 | 0.8 | 0.45 | 0.3 | 0.6 | 0.2 | 1 |
| $L_1$ | $L_2$ | $L_3$ | $L_4$ | $L_5$ | $L_6$ | $L_7$ | $L_8$ | $L_9$ |
| 12 | 4 | 4 | 3.2 | 5.5 | 1.3 | 0.6 | 4 | 1 |
| $L_{10}$ | $L_{11}$ | $d_1$ | $d_2$ | | | | | |
| 1.3 | 4.8 | 0.4 | 0.4 | | | | | |

unit: mm

According to Table 1, each of the first and second parasitic elements 3, 4 is closely adjacent to and space apart from the radiating portion 22 by a distance ($d_1$) of 0.4 mm (i.e., about $0.04\times\lambda$, where $\lambda$ denotes a wavelength in air corresponding to the operating frequency). As compared to the conventional pattern reconfigurable planar antenna that requires each of the first and second parasitic elements 13, 14 (see FIG. 1) to be spaced apart from the radiator 12 (see FIG. 1) by $0.25\times\lambda$, an area occupied by the pattern reconfigurable antenna of this embodiment can be relatively small. It should be noted that: (a) in the scenario where the operating frequency is 28 GHz, $\lambda$ is about 10.7 mm; and (b) in another scenario where the operating frequency is 30 GHz, $\lambda$ is about 10 mm.

Moreover, for each of the first and second parasitic elements 3, 4, the parasitic element has a length ($L_3$) equal to that ($L_2$) of the radiating portion 22, and a sum of the length ($L_3$) and a length ($L_6$) of a connecting line, which is formed between the parasitic element and the ground plane 5 when a corresponding one of the first and second switches ($D_1$, $D_2$) conducts, is about $0.75\times\lambda_g$, where $\lambda_g$ denotes a guided wavelength corresponding to the operating frequency. It should be noted that $\lambda_g$ can be obtained using calculation or simulation software, and is about 7 mm in the scenario where the operating frequency is 28 GHz.

The pattern reconfigurable antenna of this embodiment is operable in one of three modes that include a first mode, a second mode and a third mode.

Figure 3:
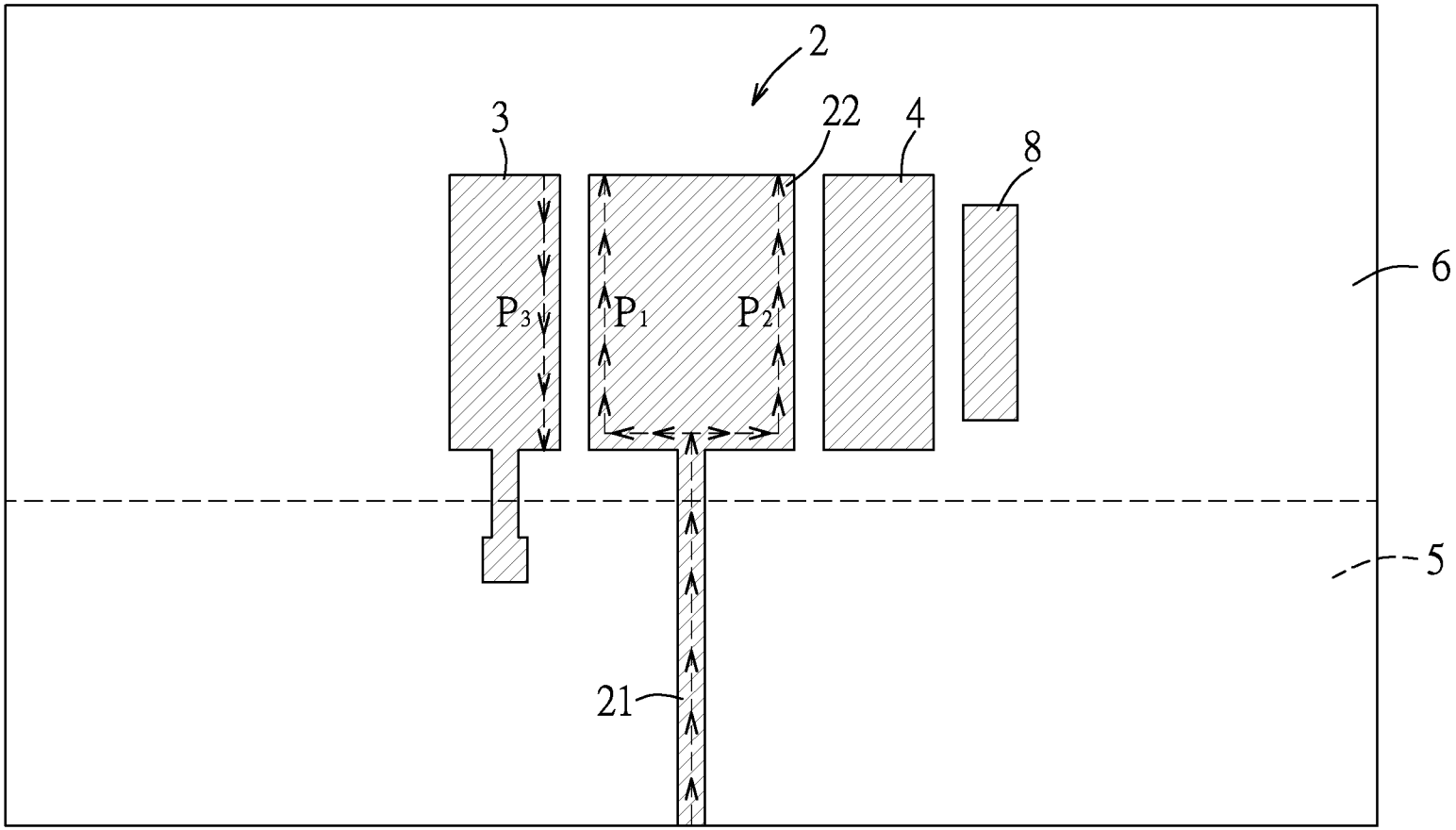
FIG. 3 is a schematic diagram illustrating the first embodiment operating in a first mode.

Referring to FIGS. 2 and 3, when only the first switch ($D_1$) conducts, the pattern reconfigurable antenna of this embodiment operates in the first mode. In the first mode, the connection between the first parasitic element 3 and the ground plane 5 is established, while the connection between the second parasitic element 4 and the ground plane 5 is not established. Therefore, the first parasitic element 3 can be viewed as an extension of the ground plane 5 and acts as a reflector, while the second parasitic element 4 acts as a director. At this time, currents mainly flow along a cancellation path ($P_1$) and a reflection path ($P_2$) in the radiating portion 22. The cancellation path ($P_1$) is near an edge of the radiating portion 22 adjacent to the first parasitic element 3. The reflection path ($P_2$) is near another edge of the radiating portion 22 adjacent to the second parasitic element 4. Since the first parasitic element 3 is closely adjacent to the radiating portion 22, a parasitic capacitance is provided between the first parasitic element 3 and the radiating portion 22, and creates a substantially short circuit in the millimeter band, thereby inducing a current that flows along an induction path ($P_3$) in the third parasitic element 3 and that is opposite in direction to the current flowing along the cancellation path ($P_1$). In addition, since the sum of the lengths ($L_3$, $L_6$) is about $0.75\times\lambda_g$, and since an open circuit and a short circuit alternate every $0.25\times\lambda_g$, standing waves can be generated in a combination of the third parasitic element 3 and the corresponding connecting line, and a short circuit can appear at the corresponding through hole 61 to generate a strong current. The current that flows along the induction path ($P_3$) can be easily induced by the current that flows along the cancellation path ($P_1$), and these two currents have opposite directions and substantially the same magnitude to thereby cancel each other. As a result, radiation from the radiating portion 22 toward the first parasitic element 3 due to the current that flows along the cancellation path ($P_1$) can be suppressed.

Figure 4:
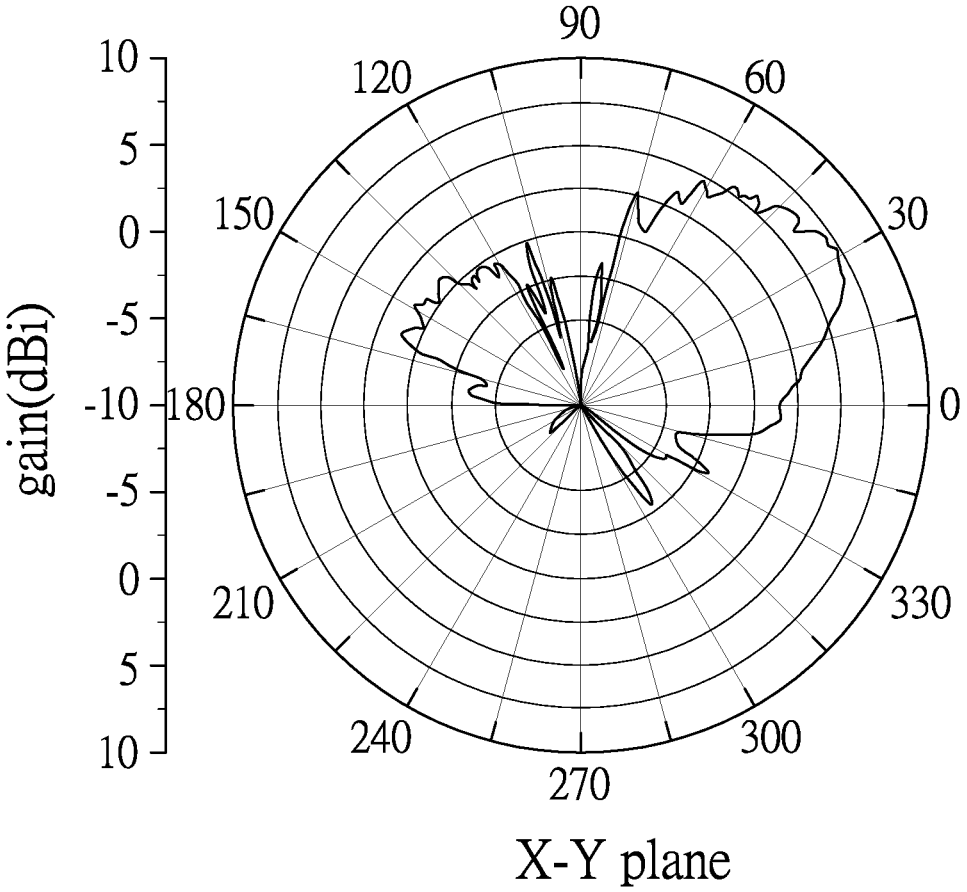
FIG. 4 is a plot illustrating a radiation pattern of the first embodiment operating in the first mode.
Figure 5:
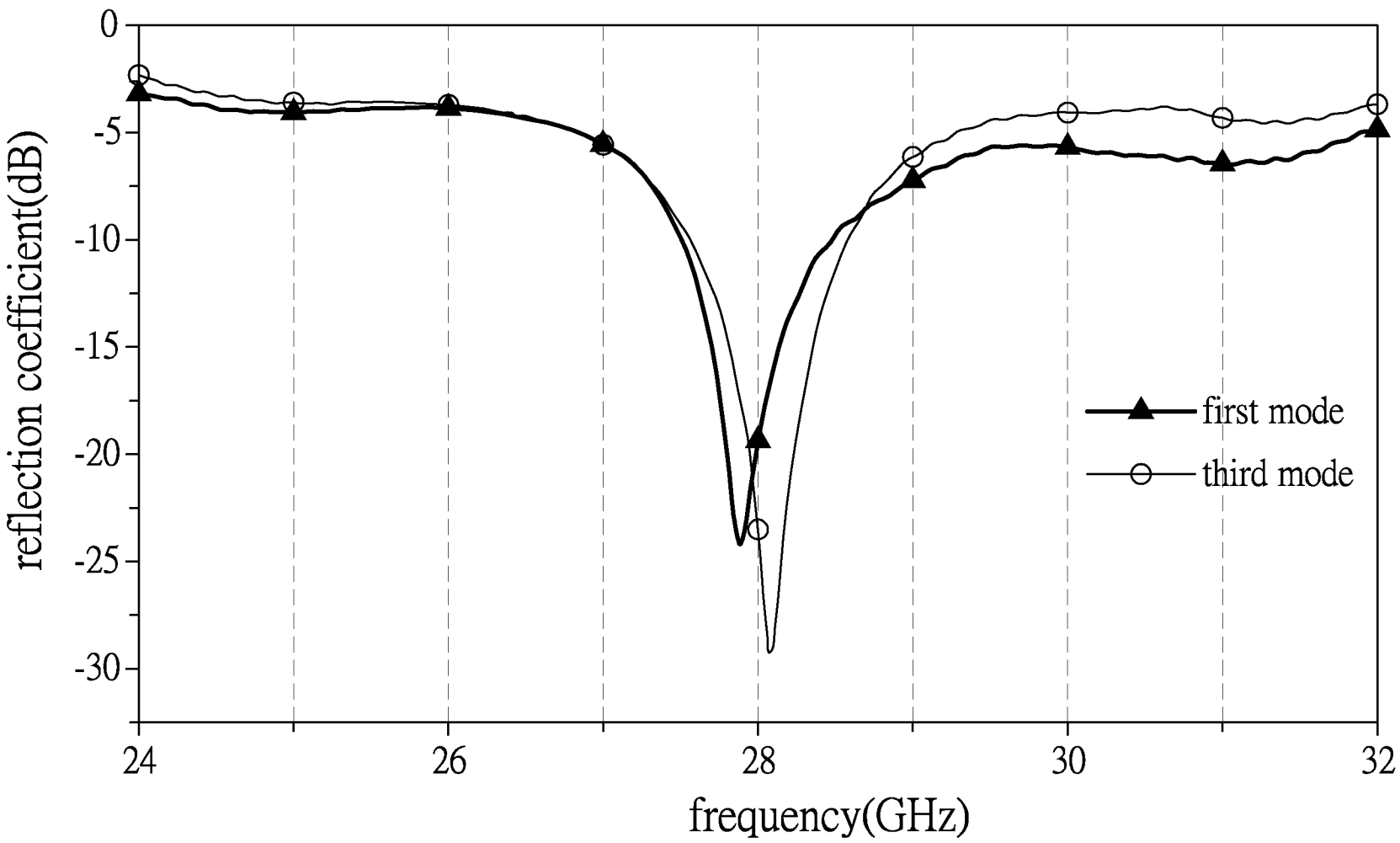
FIG. 5 is a plot illustrating a reflection coefficient of the first embodiment operating in various modes.

Moreover, in the first mode, an equivalent distance between the reflection path ($P_2$) and the first parasitic element 3 (which takes into account a physical distance between the reflection path ($P_2$) and the first parasitic element 3 and a phase delay generated due to a parasitic inductance of the first parasitic element 3) is about $0.25\times\lambda$, and a resonant length of the first parasitic element 3 (which takes into account the connection between the first parasitic element 3 and the ground plane 5) is greater than $\lambda$. Therefore, the first parasitic element 3 acts as an inductive load that will result in current phase lag; and according to the design principle of the conventional Yagi-Uda antenna, radio waves radiated by the radiating portion 22 based on the current flowing along the reflection path ($P_2$) and radio waves radiated by the first parasitic element 13 (due to absorption of the radio waves radiated by the radiator 12 based on the current flowing along the reflection path ($P_2$)) are in phase at the radiating portion 22, so these radio waves add together, enhancing power in the direct ion toward the second parasitic element 4 (i.e., the forward direction). The second parasitic element 4 and the second director 8 can be viewed as an extension of the radiating portion 22, and assist in further transmission of the added radio waves in the forward direction. Therefore, the pattern reconfigurable antenna of this embodiment has a radiation pattern as shown in FIG. 4 (in which the maximum radiation direction is oriented toward the second parasitic element 14), and a reflection coefficient as shown in FIG. 5.

Figure 6:
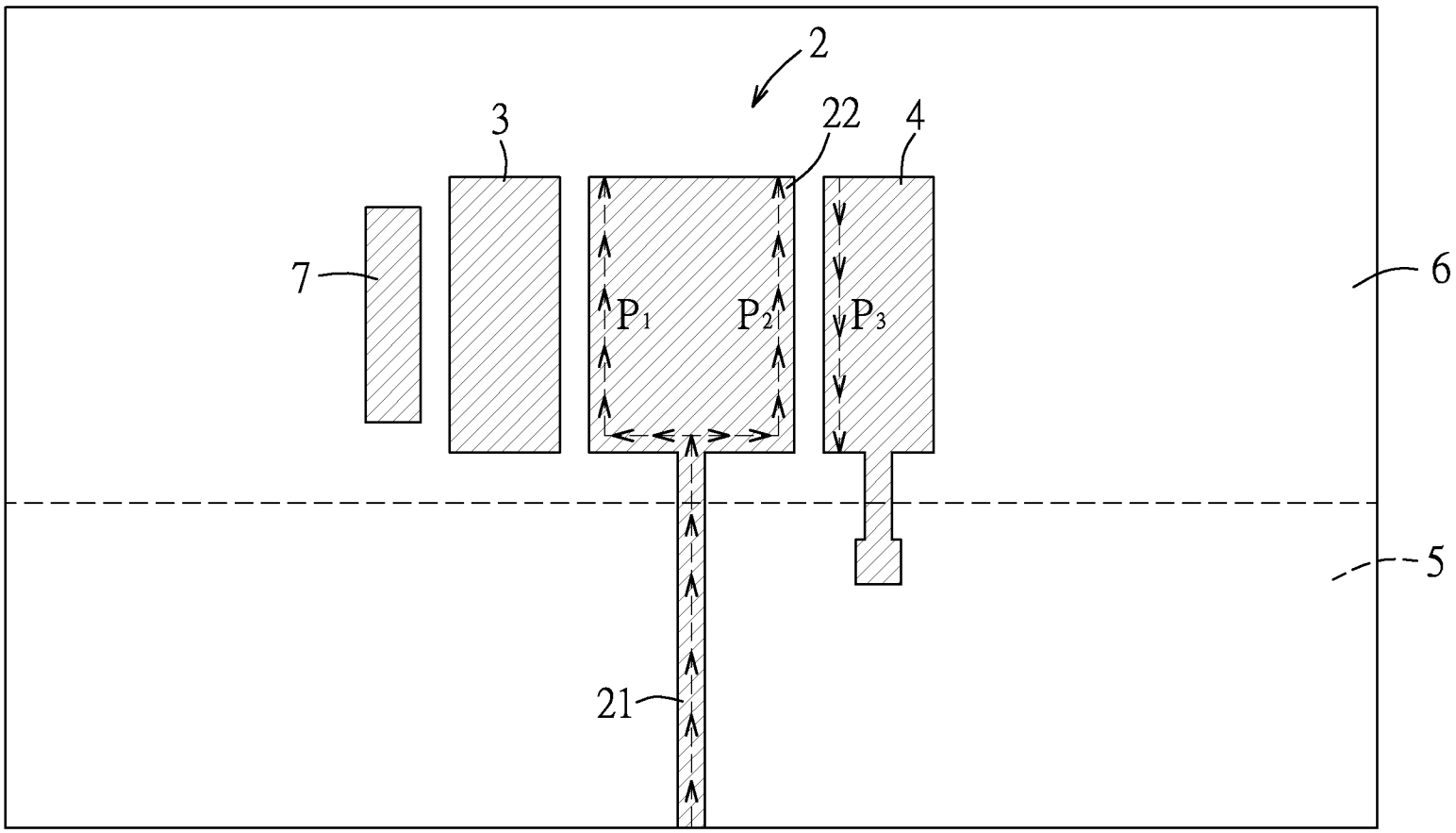
FIG. 6 is a schematic diagram illustrating the first embodiment operating in a second mode.

Referring to FIGS. 2 and 6, similarly, when only the second switch ($D_2$) conducts, the pattern reconfigurable antenna of this embodiment operates in the second mode. In the second mode, the connection between the first parasitic element 3 and the ground plane 5 is not established, the connection between the second parasitic element 4 and the ground plane 5 is established, the first parasitic element 3 acts as a director, and the second parasitic element 4 acts as a reflector. Therefore, the radiation pattern in the second mode is a flip of that in the first mode (see FIG. 4) about an axis parallel to the Y direction, and the maximum radiation direction in the second mode is oriented toward the first parasitic element 13. In addition, the reflection coefficient in the second mode is substantially the same as that in the first mode, and therefore is not depicted in FIG. 5.

Figure 7:
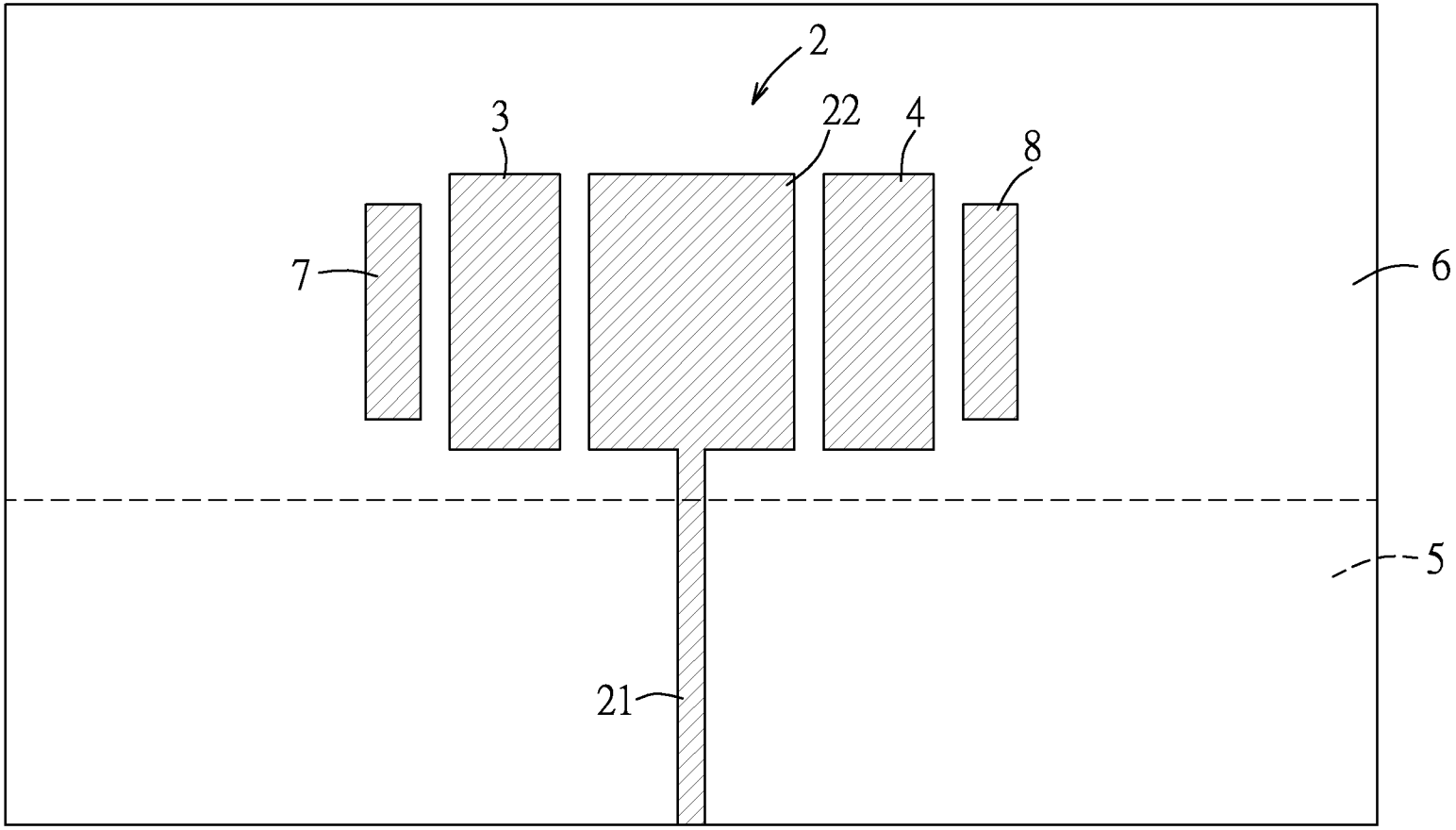
FIG. 7 is a schematic diagram illustrating the first embodiment operating in a third mode.
Figure 8:
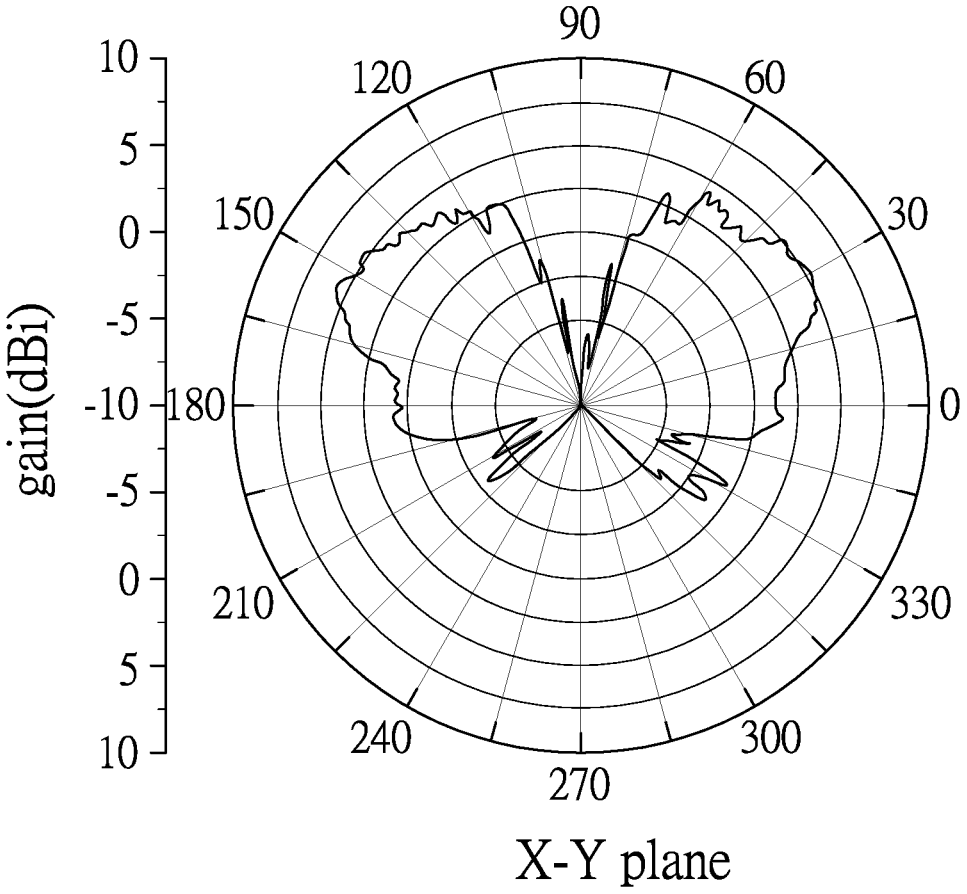
FIG. 8 is a plot illustrating the radiation pattern of the first embodiment operating in the third mode.

Referring to FIGS. 2 and 7, when none of the first and second switches ($D_1$, $D_2$) conducts, the pattern reconfigurable antenna of this embodiment operates in the third mode. In the third mode, none of the connection between the first parasitic element 3 and the ground plane 5 and the connection between the second parasitic element 4 and the ground plane 5 is established, and each of the first and second parasitic elements 3, 4 acts as a director. Therefore, the radiation pattern is substantially symmetrical with respect to an axis parallel to the Y direction as shown in FIG. 8, the maximum radiation directions are respectively toward the first and second parasitic elements 3, 4, and the reflection coefficient is as shown in FIG. 5. Since the first and second parasitic elements 3, 4 both act as directors in the third mode, the pattern reconfigurable antenna of this embodiment has greater gain in the third mode as compared to a conventional monopole antenna.

In the conventional monopole antenna, currents are simultaneously distributed on a radiator and a ground plane, and therefore performances (including an operating frequency, a bandwidth and a radiation pattern) are influenced by dimensions and a shape of the ground plane. In this embodiment, by virtue of the first and second parasitic elements 3, 4 that are closely adjacent to the radiating portion 22, electric field generated by the radiating portion 22 is concentrated near the first and second parasitic elements 3, 4, so no or little current will be induced in the ground plane 5, thereby reducing influence of the dimensions of the ground plane 5 on the radiation pattern. Therefore, the width ($W_1$) of the ground plane 5 can be reduced to 14 mm, thereby reducing the area occupied by the pattern reconfigurable antenna.

Referring back to FIG. 2, the pattern reconfigurable antenna of this embodiment further includes a first direct current (DC) bias circuit 91 and a second DC bias circuit 92. The first DC bias circuit 91 is connected to the first parasitic element 3, is for receiving a DC bias voltage, and provides the DC bias voltage to the first switch ($D_1$) via the first parasitic element 3. The first switch ($D_1$) conducts when the DC bias voltage is supplied to the first DC bias circuit 91, and does not conduct otherwise. The second DC bias circuit 92 is connected to the second parasitic element 4, is for receiving the DC bias voltage, and provides the DC bias voltage to the second switch ($D_2$) via the second parasitic element 4. The second switch ($D_2$) conducts when the DC bias voltage is supplied to the second DC bias circuit 92, and does not conduct otherwise.

In this embodiment, each of the first and second DC bias circuits 91, 92 includes a capacitor 911, 921 that is sector shaped, and a microstrip 912, 922 that has a length of $0.25\times\lambda$. The first and second DC bias circuits 91, 92 are equivalent to open circuits for RF signals (i.e., high frequency signals) flowing in the first and second parasitic elements 3, 4, and therefore these RF signals will not flow into the first and second DC bias circuits 91, 92.

Figure 9:
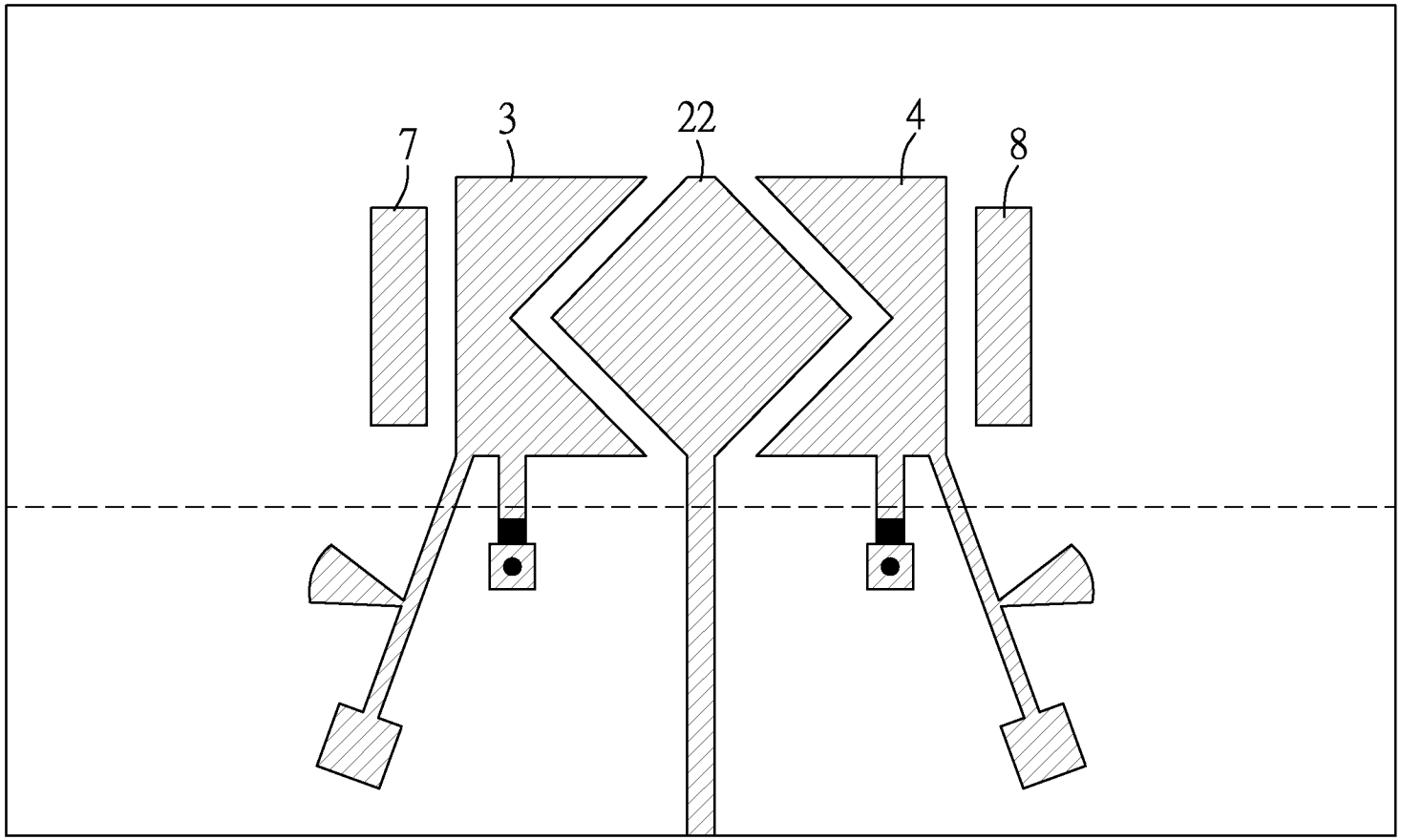
FIGS. 9 and 10 are structural diagrams illustrating a second embodiment of the pattern reconfigurable antenna according to the disclosure.
Figure 10:
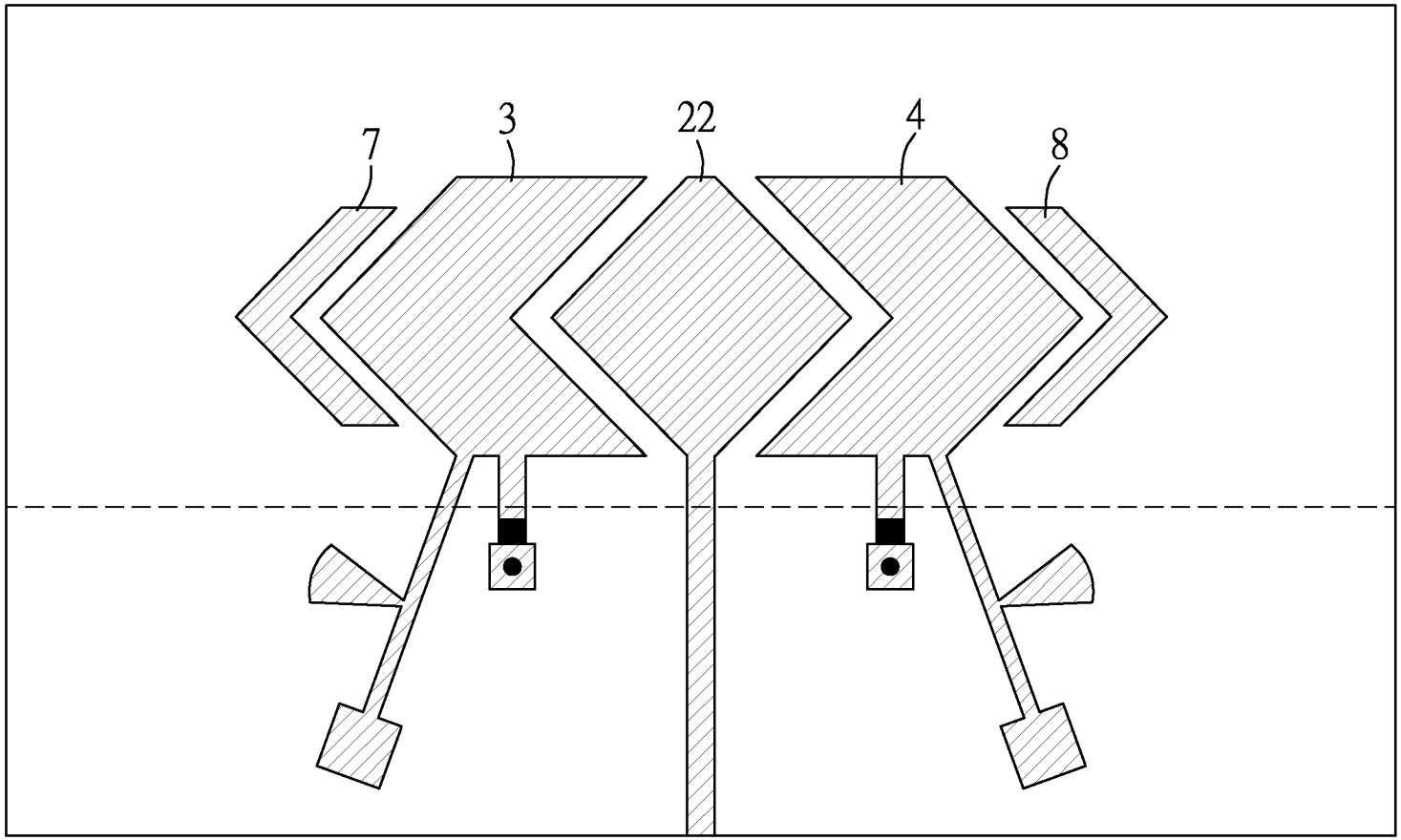

Referring to FIGS. 9 and 10, a second embodiment of the pattern reconfigurable antenna of the disclosure is similar to the first embodiment, and differs from the first embodiment at least in that: (a) the radiating portion 22 is rhombus shaped (with a vertex truncated), instead of being rectangular; and (b) each of the first and second parasitic elements 3, 4 is not rectangular. In the second embodiment, for each of the first and second parasitic elements 3, 4, an edge of the parasitic element adjacent to the radiating portion 22 is piecewise linear, and is complementary to an edge of the radiating portion 22 adjacent to the parasitic element. As shown in FIG. 10, the second embodiment may further differ from the first embodiment in that each of the first and second directors 7, 8 is not rectangular. In the second embodiment, for each of the first and second parasitic elements 3, 4 and a corresponding one of the first and second directors 7, 8, an edge of the parasitic element and an edge of the director that are adjacent to each other are piecewise linear, and are complementary to each other.

Figure 11:
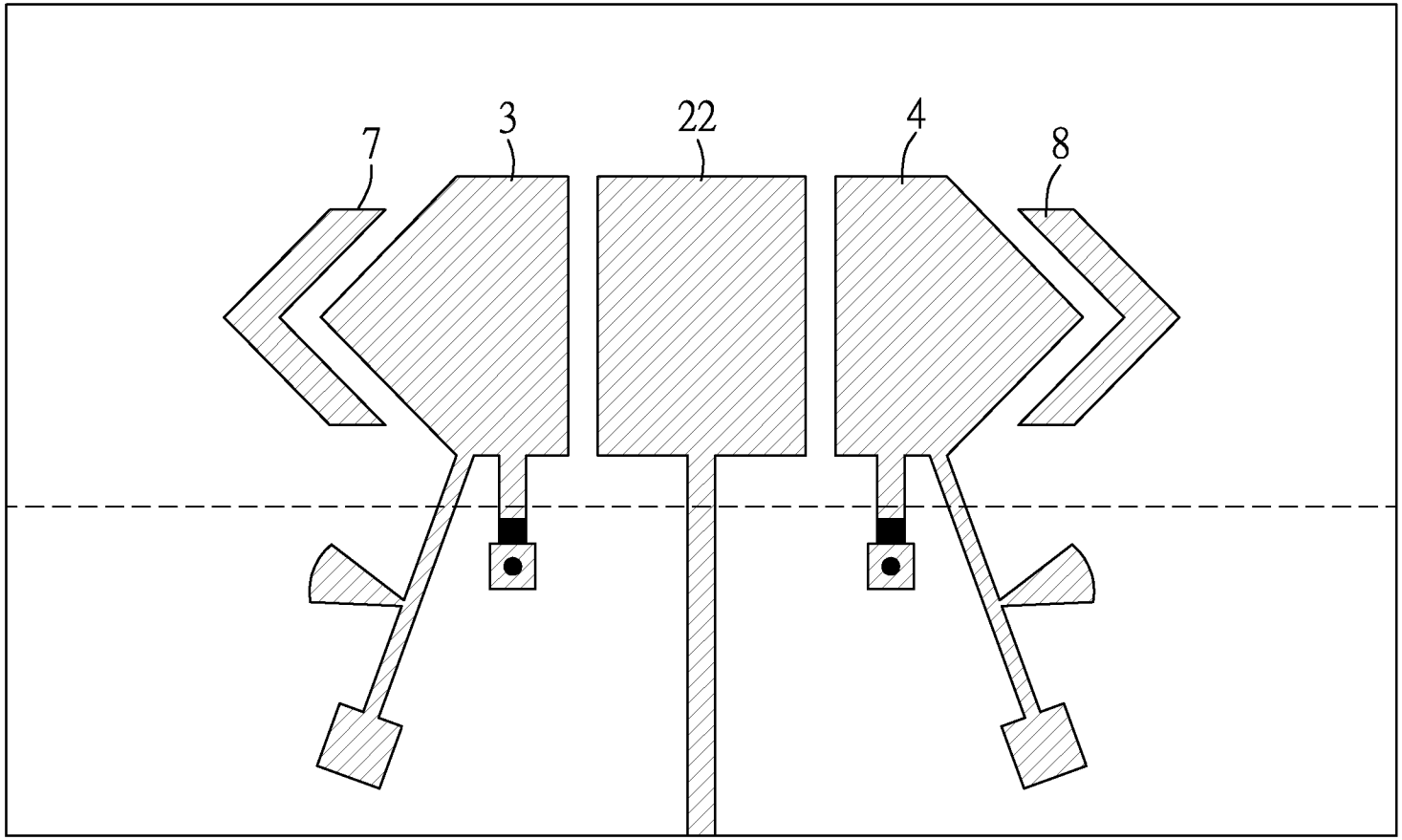
FIGS. 11 and 12 are structural diagrams illustrating a third embodiment of the pattern reconfigurable antenna according to the disclosure.
Figure 12:
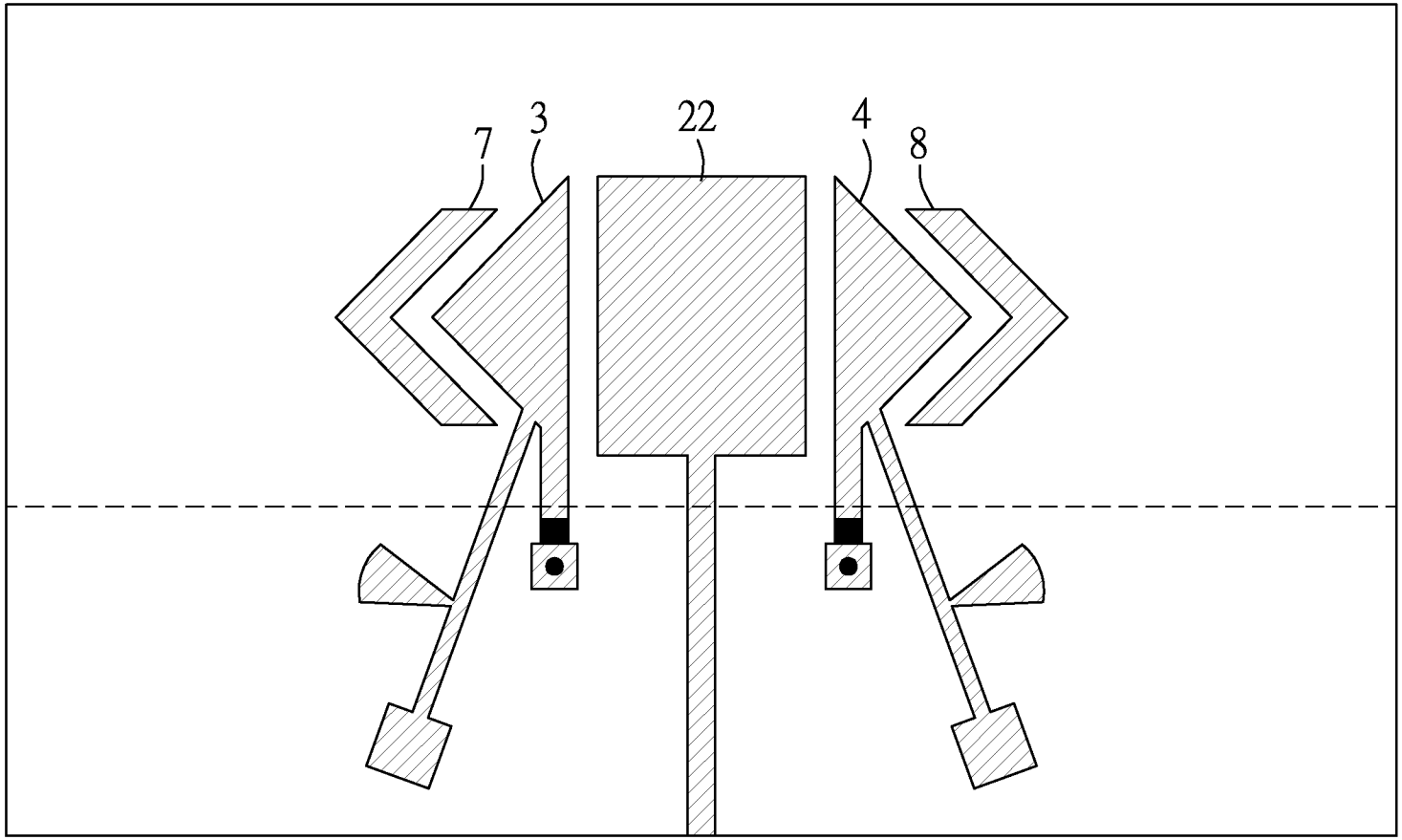

Referring to FIGS. 11 and 12, a third embodiment of the pattern reconfigurable antenna of the disclosure is similar to the first embodiment, and differs from the first embodiment in that each of the first and second parasitic 3, 4 and the first and second directors 7, 8 is not rectangular. In the third embodiment, for each of the first and second parasitic elements 3, 4 and a corresponding one of the first and second directors 7, 8, an edge of the parasitic element adjacent to the radiating portion 22 is straight and is complementary to an edge of the radiating portion 22 adjacent to the parasitic element, and an edge of the parasitic element and an edge of the director that are adjacent to each other are piecewise linear and are complementary to each other.

Figure 13:
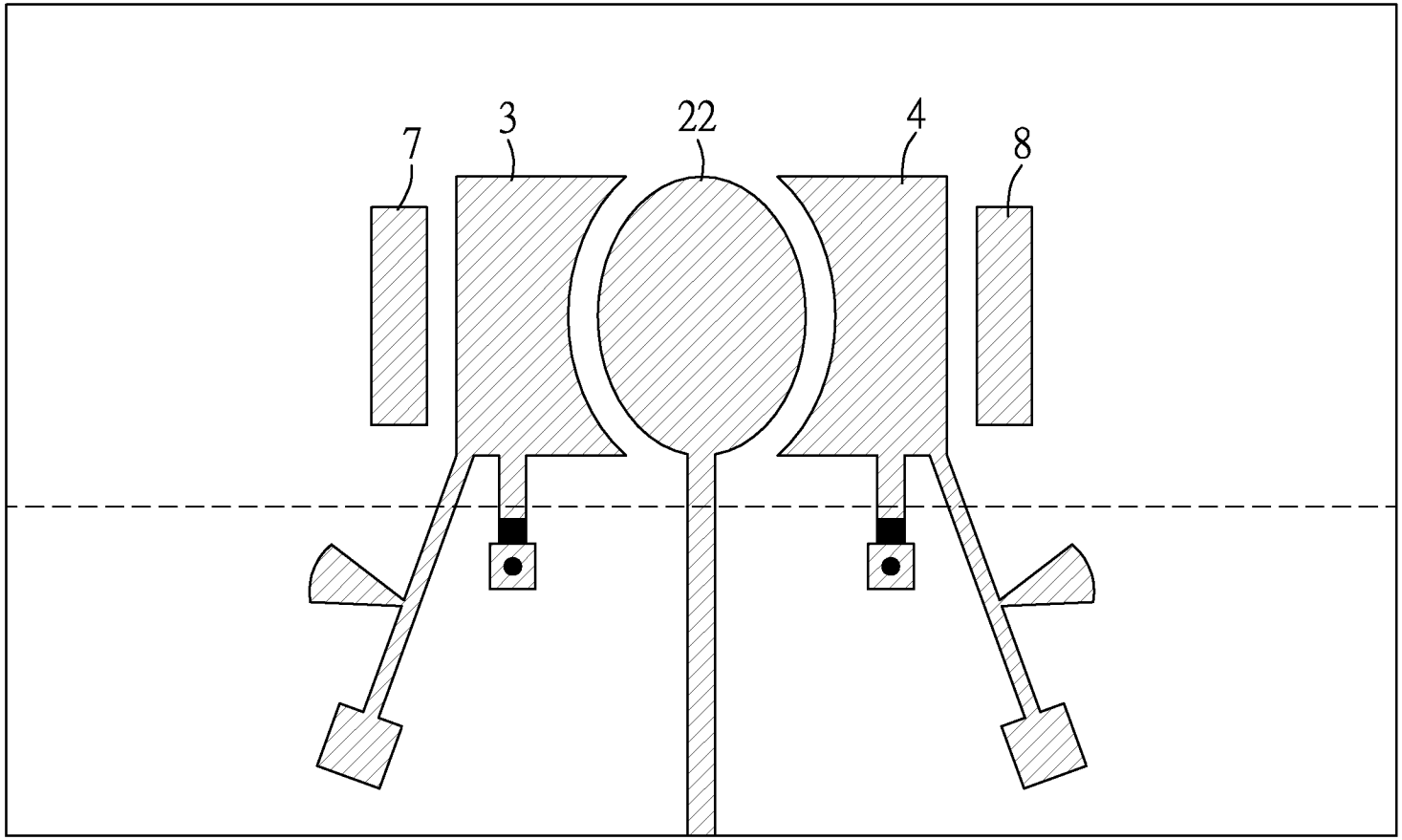
FIGS. 13 and 14 are structural diagrams illustrating a fourth embodiment of the pattern reconfigurable antenna according to the disclosure.
Figure 14:
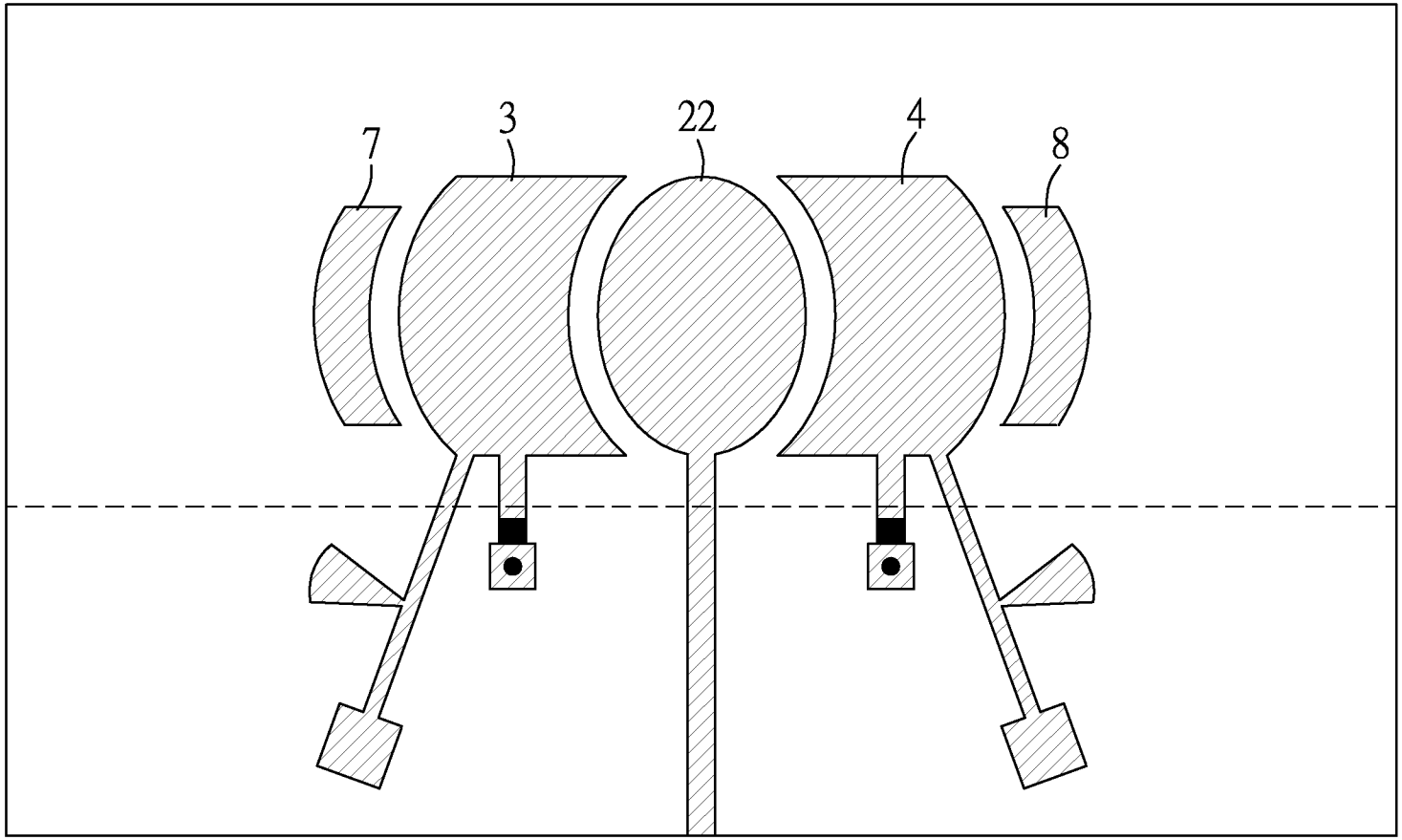

Referring to FIGS. 13 and 14, a fourth embodiment of the pattern reconfigurable antenna of the disclosure is similar to the first embodiment, and differs from the first embodiment at least in that: (a) the radiating portion 22 is circular or oval, instead of being rectangular; and (b) each of the first and second parasitic elements 3, 4 is not rectangular. In the fourth embodiment, for each of the first and second parasitic elements 3, 4, an edge of the parasitic element adjacent to the radiating portion 22 is curved, and is complementary to an edge of the radiating portion 22 adjacent to the parasitic element. As shown in FIG. 14, the fourth embodiment may further differ from the first embodiment in that each of the first and second directors 7, 8 is not rectangular. In the fourth embodiment, for each of the first and second parasitic elements 3, 4 and a corresponding one of the first and second directors 7, 8, an edge of the parasitic element and an edge of the director that are adjacent to each other are curved, and are complementary to each other.

In view of the above, the pattern reconfigurable antenna of each of the aforesaid embodiments has the following advantages.

1. The radiation pattern can be adjusted by changing the operating states of the first and second switches ($D_1$, $D_2$).

2. Since the first and second parasitic elements 3, 4 are closely adjacent to the radiating portion 22, the area occupied by the pattern reconfigurable antenna can be relatively small as compared to the conventional pattern reconfigurable planar antenna.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A pattern reconfigurable antenna comprising:

a radiator including a feed portion, and a radiating portion that is connected to said feed portion;

a first parasitic element and a second parasitic element, said first and second parasitic elements being symmetrically located at two opposite sides of said radiating portion, and being closely adjacent to and spaced apart from said radiating portion;

a ground plane located at another side of said radiating portion, and spaced apart from said first and second parasitic elements;

a first switch connected between said first parasitic element and said ground plane, and operable to establish connection between said first parasitic element and said ground plane;

a second switch connected between said second parasitic element and said ground plane, and operable to establish connection between said second parasitic element and said ground plane; and an insulating substrate including two opposite surfaces, and formed with two through holes;

said radiator, said first and second parasitic elements and said first and second switches being disposed on one of said surfaces;

said ground plane being disposed on the other one of said surfaces;

each of said first and second switches being connected to said ground plane via a respective one of said through holes.

2. The pattern reconfigurable antenna of claim 1, further comprising:

a first director located at a side of said first parasitic element that is distal from said radiating portion; and a second director located at a side of said second parasitic element that is distal from said radiating portion.

3. The pattern reconfigurable antenna of claim 1, wherein each of said first and second switches is a radio frequency switch.

4. The pattern reconfigurable antenna of claim 1, further comprising:

a first direct current (DC) bias circuit connected to said first parasitic element, for receiving a DC bias voltage, and providing the DC bias voltage to said first switch via said first parasitic element; and a second DC bias circuit connected to said second parasitic element, for receiving the DC bias voltage, and providing the DC bias voltage to said second switch via said second parasitic element;

wherein, when the DC bias voltage is supplied to said first DC bias circuit, said first switch conducts to establish the connection between said first parasitic element and said ground plane;

wherein, when the DC bias voltage is supplied to said second DC bias circuit, said second switch conducts to establish the connection between said second parasitic element and said ground plane.

5. The pattern reconfigurable antenna of claim 1, wherein each of said radiating portion and said first and second parasitic elements is a rectangular metal patch.

6. The pattern reconfigurable antenna of claim 1, wherein:

said radiating portion is a rhombus shaped metal patch; and each of said first and second parasitic elements is a metal patch having an edge that is adjacent to said radiating portion, that is piecewise linear, and that is complementary to an edge of said radiating portion adjacent to said parasitic element.

7. The pattern reconfigurable antenna of claim 1, wherein: said radiating portion is a rectangular metal patch; and each of said first and second parasitic elements is a metal patch having an edge that is adjacent to said radiating portion, that is straight, and that is complementary to an edge of said radiating portion adjacent to said parasitic element.

8. The pattern reconfigurable antenna of claim 1, wherein: said radiating portion is one of a circular metal patch and an oval metal patch; and each of said first and second parasitic elements is a metal patch having an edge that is adjacent to said radiating portion, that is curved, and that is complementary to an edge of said radiating portion adjacent to said parasitic element.

* * * * *